United States Patent [19]

Sanders et al.

[11] Patent Number: 4,496,874

[45] Date of Patent: Jan. 29, 1985

[54] ELECTRIC LAMP HAVING A MECHANICALLY CONNECTED LAMP CAP

[75] Inventors: Rudolf Sanders; Josephus F. Rijckaert, both of Eindhoven, Netherlands

[73] Assignee: U.S. Philips Corporation, New York, N.Y.

[21] Appl. No.: 376,807

[22] Filed: May 10, 1982

[30] Foreign Application Priority Data

May 27, 1981 [NL] Netherlands ..... 8102594

[51] Int. Cl.[3] ..... H01J 5/48; H01J 5/50

[52] U.S. Cl. ..... 313/318; 313/315; 339/145 R

[58] Field of Search ..... 339/144, 145, 251; 313/315, 318

[56] References Cited

U.S. PATENT DOCUMENTS

| | | | |
|---|---|---|---|
| 645,266 | 3/1900 | Kremenezky | 313/318 X |
| 961,326 | 6/1914 | Turner | 313/318 |
| 1,813,572 | 7/1931 | Gustin | 313/318 X |
| 2,028,884 | 1/1936 | Thomas | 313/318 |
| 2,692,154 | 10/1954 | Wigan | 339/144 R |
| 3,173,735 | 3/1965 | Fenn | 313/318 X |
| 3,215,972 | 11/1965 | Eriksson | 339/145 R |
| 3,356,984 | 12/1967 | Thorington et al. | 313/318 |
| 3,885,185 | 5/1975 | Tilley | 313/318 |
| 4,396,860 | 8/1983 | Hellwig et al. | 339/144 R |
| 4,405,877 | 9/1983 | Haraden et al. | 313/318 |

*Primary Examiner*—Saxfield Chatmon
*Attorney, Agent, or Firm*—Robert S. Smith

[57] ABSTRACT

In a lamp according to the invention the use of cement for connecting the lamp cap (4) has been avoided by using a split metal ring (8). The neck-shaped lamp envelope portion (2) has recesses (13) in which projecting parts (12) of the ring (8) engage. The ring (8) has lugs (14) which at least initially press against the lower edge (3) of the neck-shaped lamp envelope portion (2). The ring (8) is secured to the lamp cap (4). During assembly of the lamp cap (4) the lugs (14) are deformed. A resilient force thereby induced in said lugs pulls the ring (8) in a direction opposite to the direction in which the lamp cap (4) was moved. As soon as the ring (9) is secured to the lamp cap (4), the resilience in the lugs (14) is of no further significance.

10 Claims, 12 Drawing Figures

ELECTRIC LAMP HAVING A MECHANICALLY CONNECTED LAMP CAP

The invention relates to an electric lamp comprising a glass lamp envelope having a neck-shaped lamp envelope portion and a lower edge on said lamp envelope portion, a substantially cylindrical metal lamp cap provided on the neck-shaped lamp envelope portion and around the lower edge thereof, and an electric light source which is accommodated in the lamp envelope and which is connected to the lamp cap by current supply conductors, the lamp cap, which has an upper edge abutting against the lamp envelope, being attacked to the lamp envelope by means of a split metal ring which with its outer surface bears against the inner wall surface of the lamp cap and is secured thereto and which on its inner surface has rigid projecting parts which are each provided with a lower wall portion directed towards the said lower edge and engage in a respective recess in the neck-shaped lamp envelope portion, each of which recesses has a lower wall portion which is present near the said lower edge. Such an electric lamp is disclosed in U.S. Pat. No. 1,813,572.

For present purposes the term "lower" is used with reference to a lamp which is arranged with its axis vertical and with the lamp cap lowermost.

In most electric lamps, in particular in lamps having a blown lamp envelope, the lamp cap is fixed on the lamp envelope by means of a cement in spite of the fact that the use of cement has generally recognized disadvantages. The curing of cement is a time-consuming process in which much thermal energy is used. As a result of this, the attachment of lamp caps by means of cement is expensive. The nature of some electric lamps and/or the conditions in which they are used may in addition involve that the cement works loose during the life-time of the lamp. When the lamp has to be removed from the lamp holder, the lamp cap often remains behind therein. The removal from the holder of a detached lamp cap can be very dangerous because parts may be touched which are at an electric potential.

The disadvantages of the use of cement have involved that since the end of the last century suggestions have been made from time to time to fix lamp caps to the lamp envelope mechanically. Some suggested constructions, however, have the disadvantage that the lamp cap has to be screwed on the lamp envelope: for that purpose, according to U.S. Pat. No. 1,832,751 a ring placed on the neck-shaped lamp envelope portion is provided with screwthread; according to German Patent Specification No. 609,031 the neck-shaped lamp envelope portion itself has screwthread. These constructions cannot be used in bayonet (Swan) lamp caps.

In another suggested construction, lugs are pressed out of the sheath of the lamp cap, some of which engage in recesses in the lamp envelope and others of which engage the end face of the lamp envelope resiliently (U.S. Pat. No. 2,692,154). This construction has the disadvantage that it depends on the durability of the resilience of the lugs whether the lamp cap, also after having been loaded thermally, will remain attached rigidly to the lamp envelope. Another disadvantage is that the outer surface of the lamp cap has been changed drastically, notably that apertures have been provided therein.

In spite of the already very long recognized disadvantages of the use of cement and in spite of the many suggestions for constructions without cement, a few of which have been mentioned above, cement is still generally used nowadays, certainly in lamps having a blown lamp envelope, for securing the lamp cap. This is caused in that simple known constructions require the observation of a very great shape and size accuracy to produce a rigid coupling between lamp envelope and lamp cap which is maintained during the lifetime of the lamp. However, such an accuracy cannot be reached with blown glass lamp envelopes in series production.

The United States Patent Specification mentioned in the opening paragraph makes it seem as if the projecting parts of the metal ring fit accurately in the recesses in the neck-shaped lamp envelope portion. The parts projecting from the inner surface of the metal ring together where they approach each other most, constitute an equilateral triangle. The recesses in the neck-shaped lamp envelope portion are formed so that the deepest points of the surface of said recesses together form an equilateral triangle which is congruent with that of the metal ring.

However, the Patent Specification itself removes the initially created impression that an accurate fit of the metal ring on the neck-shaped lamp envelope portion would exist. In fact the Patent Specification states that a more snug fit of the metal ring and the neck-shaped lamp envelope portion can be obtained and that shift of said parts relative to each other can be prevented when an elastic strip of, for example, asbestos, is interposed between said parts. Thus use of an elastic strip considerably cancels the advantage of a mechanically attached lamp cap.

When in the known lamp the metal ring is proportioned so that the triangle formed by said ring is smaller than the triangle formed by the recesses in the neck-shaped lamp envelope portion, the pressure exerted by the lamp cap on the ring will be transferred to the glass of the lamp envelope and will cause said lamp envelope to crack. If on the other hand in the known lamp the triangle formed by the ring, when the ring is compressed by the lamp cap, is larger than the triangle formed by the recesses, the lamp cap has some play on the neck-shaped lamp envelope portion. Only when the ring fits exactly a useful lamp having a rigid connection of the lamp cap obtained. In view of the tolerances on the dimensions of the lamp cap, of the of the metal ring and in particular of the lamp envelope, the uniform production of lamps having a rigidly secured lamp cap while using the known construction is, at best, exceedingly difficult.

It is the object of the invention to provide lamps having a lamp cap which is secured without cement. A particular object of the invention is to provide an electric lamp with a lamp cap, which lamp has such a construction that the lamp cap can be placed on the neck-shaped portion of the lamp envelope with a simple translation and can be fixed there without requiring substantial deformations of the lamp cap. Another object of the invention is to provide a construction by which a connection between lamp cap and lamp envelope which is rigid in particular in the axial direction is realized without an elastic deformation for maintaining said connection playing an essential role.

According to the invention, this object is realized in a lamp of the kind mentioned in the opening paragraph in that the lower wall portion of each of the projecting parts is in contact with the lower wall portion of a respective recess and that the split metal ring comprises lugs which, at least at the beginning of the life-time of the lamp, exert a resilient force against the lower edge of the neck-shaped lamp envelope portion.

In order to be able to attack the split metal ring to the lamp cap it is necessary for the ring to bear with its outer surface against the inner wall of the lamp cap. For that purpose the metal ring is shaped so that the ring, after having been provided on the neck-shaped lamp envelope portion, has a larger diameter than the corresponding diameter of the lamp cap. When subsequently the lamp cap is slid over the ring until the lamp cap abuts with its edge against the lamp envelope, the diameter of the ring is reduced by the lamp cap and a good contact is produced between the inner wall of the lamp cap and the outer surface of the ring. The ring may then be secured to the lamp cap, for example, by soldering, welding or glueing.

The initially larger diameter of the metal ring is realized by its proportioning, notably by the distance between the projecting part at its inner surface and the lugs on said metal ring, and also by the direction of said lugs. Said distance and said direction are chosen to be so that the projecting parts cannot reach the bottom of the recesses in the neck-shaped lamp envelope portion.

When the lamp cap is slid over the metal ring, the diameter of the ring is reduced, the projecting parts are pressed deeper in the respective recesses, the lugs are bent out of their original position and a resilient force is generated in said lugs. This resilience with which the lugs press against the lower edge of the lamp envelope portion has two effects: (1) the resilience holds the metal ring rigidly pressed against the lamp cap so that these two elements can be attached to each other, and (2) the resilience urges the metal ring as much as is then possible in the direction towards the lower edge of the lamp envelope. This second function is of very great importance.

In the lamp according to the Patent Specification mentioned in the opening paragraph the metal ring is also compressed when the lamp cap is fitted. The frictional force occurring between the lamp cap and the metal ring has for its result that the metal ring is dragged along by the lamp cap towards the (wider part of the) lamp envelope. When the lamp cap, abutting against the lamp envelope, is then secured to the ring, there is some residual play of the lamp cap relative to the lamp envelope in the axial direction of the lamp cap.

The second function of the lugs is, however, to prevent any such play in the lamp according to the invention. The lugs ensure that, while the lamp cap is being moved in its axial direction until it abuts against the lamp envelope, the metal ring is kept forced in the opposite direction. When the lamp cap and the metal ring are then secured together, the lamp cap is firmly fixed in its axial direction when the lamp cap and ring have been secured together, the lugs have fulfilled their function and it is of no significance whatsoever whether or not their resilience is maintained during the lifetime of the lamp. The thermal load of the lamp cap may reduce the resilience of the lugs, but this has no result on the rigidity of the connection between lamp envelope and lamp cap. In spite of differences in dimensions and shapes which occur for each individual lamp, the spacing between the upper edge of the lamp cap and the lower wall of each of the projecting parts in each individual lamp according to the invention, after the metal ring and the lamp cap have been secured together, is equal to the spacing between the place where the lamp cap abuts against the lamp envelope and the lower wall of the respective recess in which the projecting parts engage. The effect of the construction according to the invention is equal to that of a mechanically secured lamp cap made to size for each individual lamp.

The recesses in the neck-shaped lamp envelope portion and the rigid projecting parts of the metal ring may have a variety of shapes. For example, in a cross-section in the plane of the axis of the lamp cap they may have the shape of a V, of a U, of a U having spread limbs, or of an arc of a circle. In a plane perpendicular to the axis of the lamp cap the projecting parts and the recesses, respectively; may be rectilinear. In a favourable embodiment the portions of the recesses in said plane, however, are curved concave, for example according to an arc of a circle, and the projecting parts are curved convex. When the recesses and the projecting parts in both said planes are curved according to an arc of a circle, the radii of curvature may be equal or different, for example, may both be 2 to 3 mm or one 2 to 3 mm and the other, in a plane at right angles to the axis of the lamp cap, 6 to 9 mm. These figures are meant only to indicate possibilities and have no limiting meaning. In a favourable embodiment at least the projecting parts have a lower wall portion which extends inwardly of the lamp, away from the lower edge of the neck-shaped lamp envelope portion. The embodiment has the advantage that a larger force is induced in the lugs when the projecting parts are forced deeper into the recesses. This effect also occurs when the recesses have a lower wall portion, which also extends away from the lower edge and occurs to a more considerable extent when both the lower wall portion of the projecting parts and that of the recesses extend in this manner.

Although for the formation of the projecting parts and for the formation of the recesses tools may be used which are suitable for making the recesses substantially the same shape and size as the projecting parts, this is not necessary. It is sufficient for the projecting parts to be able to engage in the recesses. In fact, it is by no means endeavoured with the lamp according to the invention that the projecting parts fill the recesses. Such an endeavour would be doomed to failure in view of the size and shape fluctuations occurring in processing glass products.

In addition to an excellent coupling of the lamp cap to the lamp envelope in an axial direction of the lamp cap, the construction described also permits of obtaining a good coupling in a tangential direction. The possible rotation of the lamp cap with respect to the lamp envelope is restricted to very small angles of, for example, 1°. In the embodiment described in which the lower wall of the projecting parts and/or that of the recesses extent inwardly of the lamp away from the lower edge of the neck-shaped lamp envelope portion, an even further restriction is obtained. A coupling which is very rigid in a tangential direction is obtained when the recesses and the projecting parts in a plane normal to the axis of the lamp cap are curved concave and convex, respectively.

It has been found that excellent results can be obtained with two recesses and two projecting parts. If desired, however, a larger number may be chosen. The recesses and projecting parts are generally distributed uniformly around the circumference of the neck-shaped lamp envelope portion and the metal ring, respectively.

In one embodiment the metal ring has a lug for each projecting part. This may be placed in the axial direction of the lamp cap below the projecting part. However, it is also possible to place a respective lug on each side of each projecting part.

The metal ring may be attached to the lamp cap by soldering. For that purpose, in one embodiment the ring has been covered with solder externally beforehand. In a modified embodiment a quantity of solder is provided in a cavity in the outer surface of the ring, which cavity has been formed during the formation of a projecting part on the inner surface.

The metal ring may alternatively be connected by gluing or welding, in particular by welding with a laser. A laser-made weld can be recognized by a hole in the lamp cap which is filled for the greater part with a solidified melt of the material of the lamp cap and the ring. Laser welding has proved to be a particularly rapid, reliable and also otherwise attractive method of securing a lamp cap and a ring.

A variety of materials may be used for the metal ring. For example, aluminium and various brass types may be used: alloys having as main component copper and as an important side component zinc or nickel, possibly with small additions of iron, silicon, aluminium, manganese and/or lead. A suitable material substantially comprises, for example, 45–67% by weight of copper, 12–45% by weight of zinc and 10–26% by weight of nickel.

In a favourable embodiment the metal ring has a narrowing slot on its upper edge and one of the two current supply conductors is passed between the neck-shaped lamp envelope portion and the metal ring and is passed through the incision and is clamped therein. When the metal ring is connected to the lamp cap a side contact is simultaneously formed on the lamp cap in this embodiment.

The lamp in accordance with the invention may have a filament or a discharge vessel as a light source. The lamp is particularly suitable for use at high ambient temperatures, e.g. in closed luminaires and in furnaces and furthermore to be designed as a directed radiator in which the concentration of light results in a high temperature of the lamp cap.

Embodiments of the lamp according to the invention are shown in the drawing, in which FIG. 1 is a side elevation of a lamp according to the invention with the lamp cap partly broken away and the metal ring in a cross-sectional view;

FIG. 2 is a detail of FIG. 1 on an enlarged scale in a partly broken-away side elevation:

FIGS. 3*a* and 3*b* are a side elevation, partly in cross-section, and a plan view, respectively, of a ring as used in FIG. 2;

FIGS. 4*a* and 4*b* show a first modified embodiment of FIGS. 3*a* and 3*b;*

FIGS. 5*a* and 5*b* show a second modified embodiment of FIGS. 3*a* and 3*b;*

FIGS. 6*b* and 6*a* show a modified embodiment of FIGS. 4*a* and 4*b*.

Figure 1:
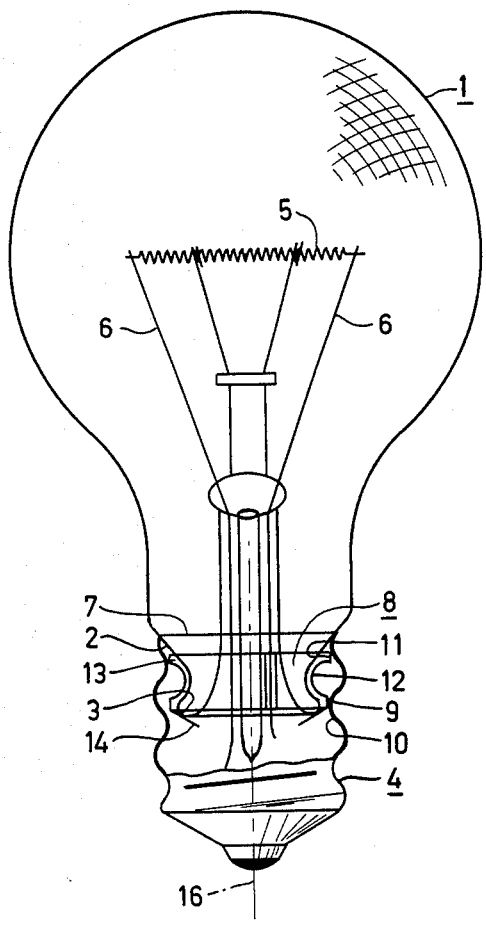

In FIG. 1, a blown glass lamp envelope 1 has a neck-shaped lamp envelope portion 2 having a lower edge 3. A substantially cylindrical metal lamp cap 4 having an axis 16 is placed on the neck-shaped lamp envelope portion 2 around the lower edge 3. A filament 5 connected to the lamp cap 4 by means of current supply conductors 6 is accommodated in the lamp envelope as a light source. The lamp cap 4 has an upper edge 7 which abuts against the lamp envelope 1. A split metal ring 8 bears with its outer surface 9 against the inner wall surface 10 of the lamp cap 4 and is secured thereto. The metal ring 8 on its inner surface 11 has projecting parts 12 which engage in respective recesses 13 in the neck-shaped lamp envelope portion. The metal ring 8 has lugs 14 which press against the lower edge 3 of the neck-shaped lamp envelope portion 2.

Figure 2:
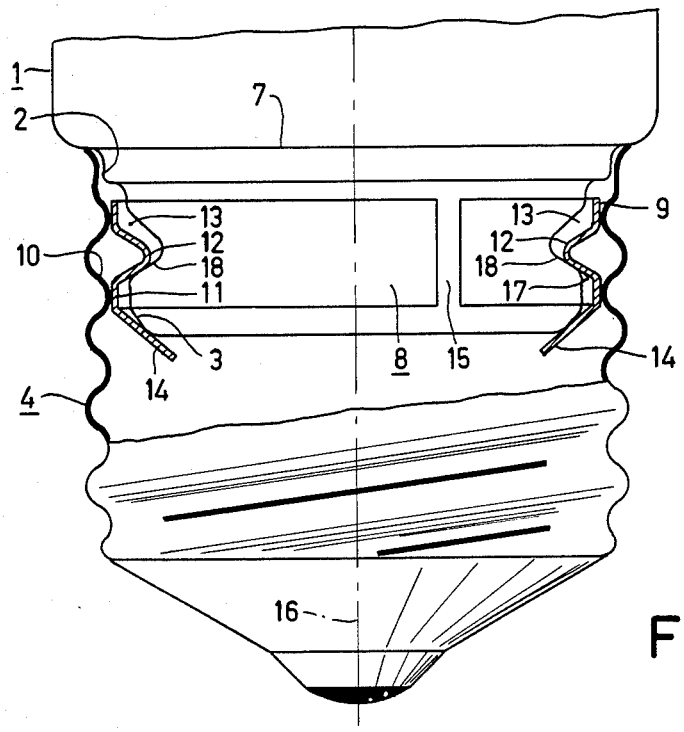

In FIG. 2, corresponding parts to those shown in FIG. 1 bear the same reference numerals. The interruption in the metal ring 8 is denoted by 15. The Figure shows that there is no congruence between the projecting parts 12 and the recesses 13. In spite of this the lamp has a rigid connection between lamp cap 4 and lamp envelope 1. The projecting parts 12 have a lower wall portion 17 which is directed towards the lower edge 3 of the neck-shaped lamp envelope portion 2, while the recesses 13 have a lower wall portion 18 which is present near said lower edge 3. The lower wall portions 18 are in contact with the respective lower wall portions 17.

To assemble the lamp, the metal ring 8 is placed on the neck-shaped lamp envelope portion 2, with the projecting parts 12 in engagement with the corresponding recesses. 13. At this stage the interruption 15 is wider than is shown in FIG. 2. The lamp cap 4 is then moved over the metal ring 8 so that its upper edge 7 abuts against the lamp envelope 1. The metal ring 8 is thereby reduced in diameter and the interruption 15 is reduced in width. The projecting parts 12 are thus pressed deeper into the recesses 13. Also the lugs 14 are pressed more strongly against the lower edge 3 and are forced outwardly of ring 8 from their original positions. The resilience generated in the lugs 14 not only presses the ring 8 with its outer surface 9 more strongly against the inner wall 10 of the lamp cap but also pulls the lower wall portion 17 of the projecting parts 12 more strongly against the lower wall portion 18 of the respective recess 13. While during assembly the lamp cap 4 in the Figure is moved upwards as much as possible (till abutment), the lugs, pressing against the lower edge 3, pull the metal ring 8 downwards. The metal ring 8 and the lamp cap 4 are then united by welding. The spacing between the lower wall portion 18 of the recess 13 and the place where the lamp cap 4 abuts against the lamp envelope 1 is bridged entirely by two rigidly interconnected metal parts (4, 8). A rigid coupling is thus produced thereby not only in the direction of the axis 16 of the lamp cap but also in directions normal thereto.

The V-shaped projecting parts 12 are elongate in the direction normal to the plane of the drawing. This is also the case with the recesses 13. Thus if a extend inwardly of the lamp away from the lower edge 3 of the neck-shaped lamp envelope portion 2. Thus if a torsional force is exerted on the lamp cap 4 with respect to the lamp envelope 1, said force would tend to move the projecting parts 12 in the upward direction as viewed in FIG. 2 due to the interaction between wall portions 17 and 18. However, the edge 7 abutting against the lamp envelope 1 prevents any such movement.

Figure 3A:
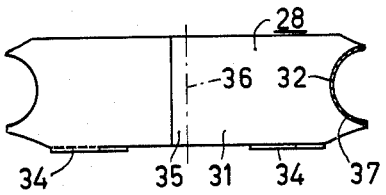
Figure 3B:
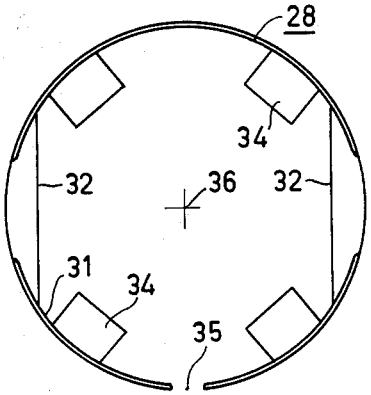

In FIGS. 3*a* and 3*b* a metal ring 28 has an interruption 35. The ring has projecting parts 32 on its inner surface 31. Said projecting parts have a lower wall portion 37 which ascends from the outside to the inside. The ring has lugs 34 which are at right angles to the inner surface 31. The position of the axis of a lamp cap is denoted by 36.

In a cross-section through the axis 36 the projecting parts 32 are curved according to an arc of a circle, they are elongate in cross-section at perpendicular to the axis 36.

Figure 4A:
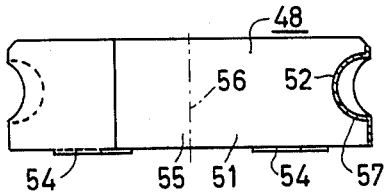
Figure 4B:
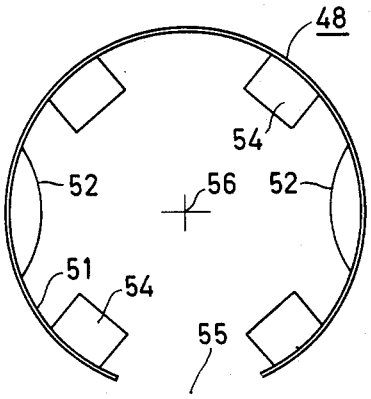

In FIGS. 4*a* and 4*b* corresponding parts are referred to by reference numerals which are 20 higher than in FIGS. 3*a* and 3*b*. The projecting parts 52 are also curved according to an arc of a circle in the plane of drawing of FIG. 4*b* but with a larger radius than in FIG. 4*a*.

Figure 5A:
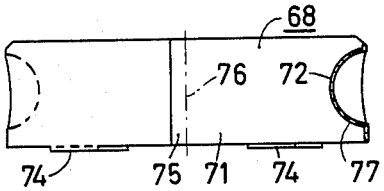
Figure 5B:
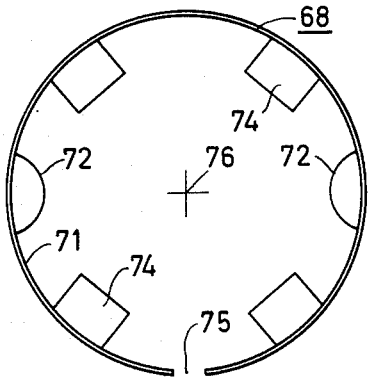

In FIGS. 5*a* and 5*b* corresponding parts are referred to by reference numerals which are 20 higher than in FIGS. 4*a* and 4*b*. The radius of curvature of the projecting parts 72 in the plane of the drawing of FIG. 5*a* is equal to that of FIG. 5*b*.

Figure 6A:
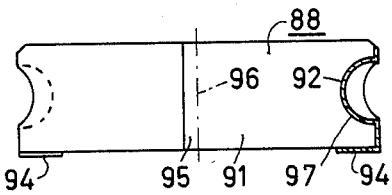
Figure 6B:
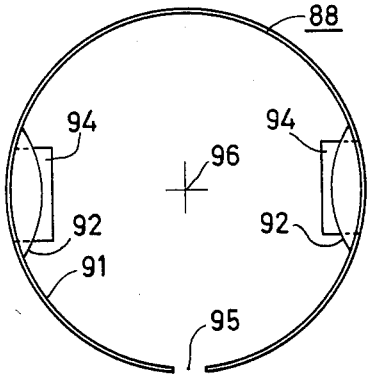

In FIGS. 6*a* and 6*b* corresponding parts are referred to by reference numerals which are 40 higher than in FIGS. 4*a* and 4*b*. The lugs 94 are present in the direction axially below the projecting parts 92.

Figure 7:
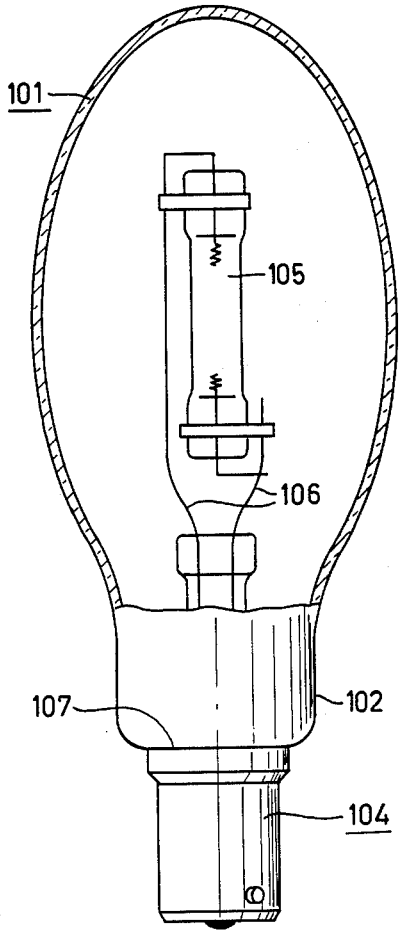
FIG. 7 is a side elevation of a discharge lamp partly broken away.
Figure 8:
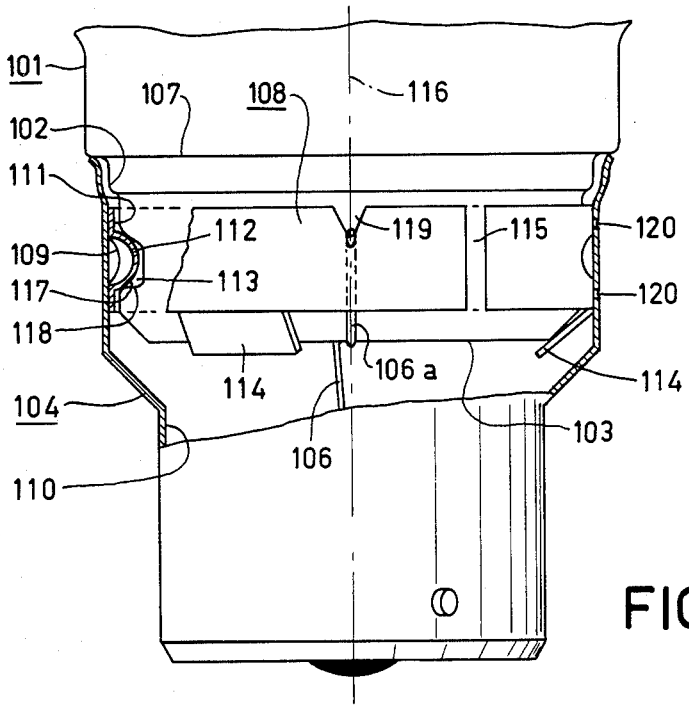
FIG. 8 is a side elevation of a detail of FIG. 7 partly broken away.

In FIGS. 7 and 8 the reference numerals are 100 higher than those of corresponding parts of FIGS. 1 and 2. The light source 105 is a high-pressure gas discharge vessel and the lamp cap 104 is a bayonet cap.

In FIG. 8 the recess 113 has a lower wall portion 118 which is at right angles to the axis 116 of the lamp cap 104. Two current supply wires 106 and 106*a* extend from the lamp envelope, wire 106 being connected to the central contact on lamp cap 104. The current supply wire 106*a* is threaded between the split metal ring 108 and the neck-shaped lamp envelope portion 102 and drawn into a narrowing slot 119 in the ring 108 so as to be clamped therein and make good electrical contact therewith. The lamp cap 104 is secured and electrically connected to the metal ring 108 by means of laser welds 120, by which a reliable side contact of the lamp cap is also formed.

What is claimed is:

1. An electric lamp comprising a glass lamp envelope having a neck-shaped lamp envelope portion and a lower edge on said lamp envelope portion, a substantially cylindrical metal lamp cap provided on the neck-shaped lamp envelope portion and around the lower edge thereof, and an electric light source accommodated in the lamp envelope and connected to the lamp cap by current supply conductors, the lamp cap which has an upper edge abutting against the lamp envelope, being attached to the lamp envelope by means of a split metal ring with its outer surface bears against the inner wall surface of the lamp cap and is secured thereto, and on its inner surface has rigid projecting parts which are each provided with a lower wall portion directed towards the said lower edge and engage in a respective recess in the neck-shaped lamp envelope portion, each of which recesses has a lower wall portion present near the said lower edge, characterized in that the lower wall portion of each of the projecting parts is in contact with the lower wall portion of a respective recess and that the split metalring has lugs which, at least at the beginning of the lifetime of the lamp, exert a resilient force against the lower edge of the neck-shaped lamp envelope portion.

2. An electric lamp as claimed in claim 1, characterized in that the lower wall portion of each projecting part extends inwardly of the lamp away from the lower edge of the neck-shaped lamp envelope portion.

3. An electric lamp as claimed in claim 2, characterized in that, the lower wall portion of each recesses also extends inwardly of the lamp away from the lower edge.

4. An electric lamp as claimed in claim 2 or 3, characterized in that in a plane through the axis of the lamp cap the projecting parts are curved according to an arc of a circle.

5. An electric lamp as claimed in claim 4, characterized in that in a plane at right angles to the axis of the lamp cap the projecting parts are curved according to an arc of a circle.

6. An electric lamp as claimed claims 1, 2 or 3, characterized in that the recesses have substantially the same shape and size as the projecting parts.

7. An electric lamp as claimed in claims 1, 2, 3 or 6, characterized in that the metal ring has at least one of said lugs for each of the projecting parts.

8. An electric lamp as claimed in claims 1, 2, 3, 6 or 7, characterized in that, in the axial direction of the lamp cap, each lug is located below a respective projecting part.

9. An electric lamp as claimed in claims 1, 2, 3 or 6, characterized in that a respective lug is located on each side of and beneath each projecting part.

10. An electric lamp as claimed in any of the claims 1 2, 3 or 6, characterized in that the metal ring is connected to the lamp cap by laser welding.

* * * * *